US010717288B2

(12) United States Patent
Mori

(10) Patent No.: US 10,717,288 B2
(45) Date of Patent: Jul. 21, 2020

(54) LIQUID DISCHARGE APPARATUS

(71) Applicant: BROTHER KOGYO KABUSHIKI KAISHA, Nagoya-shi, Aichi-ken (JP)

(72) Inventor: Shogo Mori, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/851,349

(22) Filed: Dec. 21, 2017

(65) Prior Publication Data

US 2018/0281436 A1 Oct. 4, 2018

(30) Foreign Application Priority Data

Mar. 31, 2017 (JP) ..... 2017-073002

(51) Int. Cl.

| | |
|---|---|
| ***B41J 2/17*** | (2006.01) |
| ***B41J 2/175*** | (2006.01) |
| ***B41J 2/14*** | (2006.01) |
| *B41J 2/04* | (2006.01) |

(52) U.S. Cl.

CPC ..... *B41J 2/17556* (2013.01); *B41J 2/14233* (2013.01); *B41J 2/04* (2013.01); *B41J 2202/08* (2013.01)

(58) Field of Classification Search

None

See application file for complete search history.

(56) References Cited

U.S. PATENT DOCUMENTS

| | | | | |
|---|---|---|---|---|
| 5,622,897 | A | 4/1997 | Hayes | |
| 2006/0109314 | A1* | 5/2006 | Cabal | B41J 2/14 347/61 |
| 2006/0209138 | A1 | 9/2006 | Kachi | |
| 2007/0109364 | A1 | 5/2007 | Ito | |
| 2007/0263038 | A1 | 11/2007 | Bibl | |
| 2009/0141062 | A1 | 6/2009 | Takano et al. | |
| 2010/0079533 | A1* | 4/2010 | Gulvin | B41J 2/04528 347/17 |
| 2013/0070016 | A1* | 3/2013 | Maeda | B41J 29/393 347/19 |
| 2014/0063125 | A1* | 3/2014 | Kondo | B41J 2/14233 347/50 |
| 2014/0132677 | A1 | 5/2014 | Kondo | |

FOREIGN PATENT DOCUMENTS

| | | | |
|---|---|---|---|
| EP | 2 287 006 | A1 | 2/2011 |
| JP | 2010-194895 | A | 9/2010 |
| JP | 2013-202840 | A | 10/2013 |
| JP | 2016-30332 | A | 3/2016 |

OTHER PUBLICATIONS

Extended European Search Report issued in related European Patent Application No. 17209707.3, dated Jul. 16, 2018.

* cited by examiner

*Primary Examiner* — Erica S Lin

(74) *Attorney, Agent, or Firm* — Merchant & Gould P.C.

(57) ABSTRACT

A liquid discharge apparatus includes a plate-like actuator including a plurality of individual electrodes aligning in a first direction, a channel member being joined to one surface of the actuator to include a plurality of pressure chambers aligning along the first direction, and a heater being arranged directly or indirectly on the other surface of the actuator and having a convex portion in direct or indirect contact with the plate-like actuator. The convex portion is arranged between the plurality of individual electrodes and an outer edge of the actuator.

14 Claims, 14 Drawing Sheets

LIQUID DISCHARGE APPARATUS

CROSS REFERENCE TO RELATED APPLICATION

The present application claims priority from Japanese Patent Application No. 2017-073002 filed on Mar. 31, 2017, the disclosures of which is incorporated herein by reference in its entirety.

BACKGROUND

Field of the Invention

The present disclosure relates to liquid discharge apparatuses configured to discharge liquid such as an ink.

Description of the Related Art

Conventionally, there are disclosed liquid droplet jet apparatuses including a channel unit in which ink flow channels are formed to communicate with a plurality of nozzles, a pressure application device for causing a liquid to be jetted from the nozzles, and a wiring substrate outputting a drive signal to the pressure application device. The liquid droplet apparatuses form image by jetting an ink from the nozzles onto a recording medium such as paper.

SUMMARY

If the viscosity of the ink depends on temperature and when the temperature decreases, then it becomes difficult for the ink to be jetted from the nozzles. Therefore, a heater may be provided for the channel unit to prevent the ink from decreasing in temperature.

However, even if the heater is provided, the channel unit is still liable to easily cooling down in its peripheral portion so as to bring about uneven temperature of the ink flowing inside the channel unit. In such a case, variation occurs in the viscosity of the ink jetted from the respective nozzles, thereby bringing about decrease in image quality.

The present disclosure is made in view of the above situation, and an object thereof is to provide a liquid discharge apparatus capable of uniformizing the liquid temperature to restrain the image quality from decrease.

According to an aspect of the present disclosure, there is provided a liquid discharge apparatus including: a plate-like actuator including a plurality of individual electrodes aligning in a first direction; a channel member joined to one surface of the actuator and including a plurality of pressure chambers aligning in the first direction; and a heater arranged directly or indirectly on the other surface of the actuator and including a convex portion in direct or indirect contact with the plate-like actuator. The convex portion is arranged between the plurality of individual electrodes and an outer edge of the actuator.

Being close to the external air, the periphery of the channel member is easier to cool than the center. Because the convex portion is arranged between the plurality of individual electrodes and an outer edge of the actuator, a large amount of heat is supplied to the part of the actuator being easy to cool, such that the heat transfers therefrom to the center of the channel member. Therefore, it is possible to uniformize the temperature of the channel member; thus, it is possible to uniformize the ink temperature, thereby restraining the image quality from decreasing.

DESCRIPTION OF THE EMBODIMENTS

First Embodiment

Figure 1:
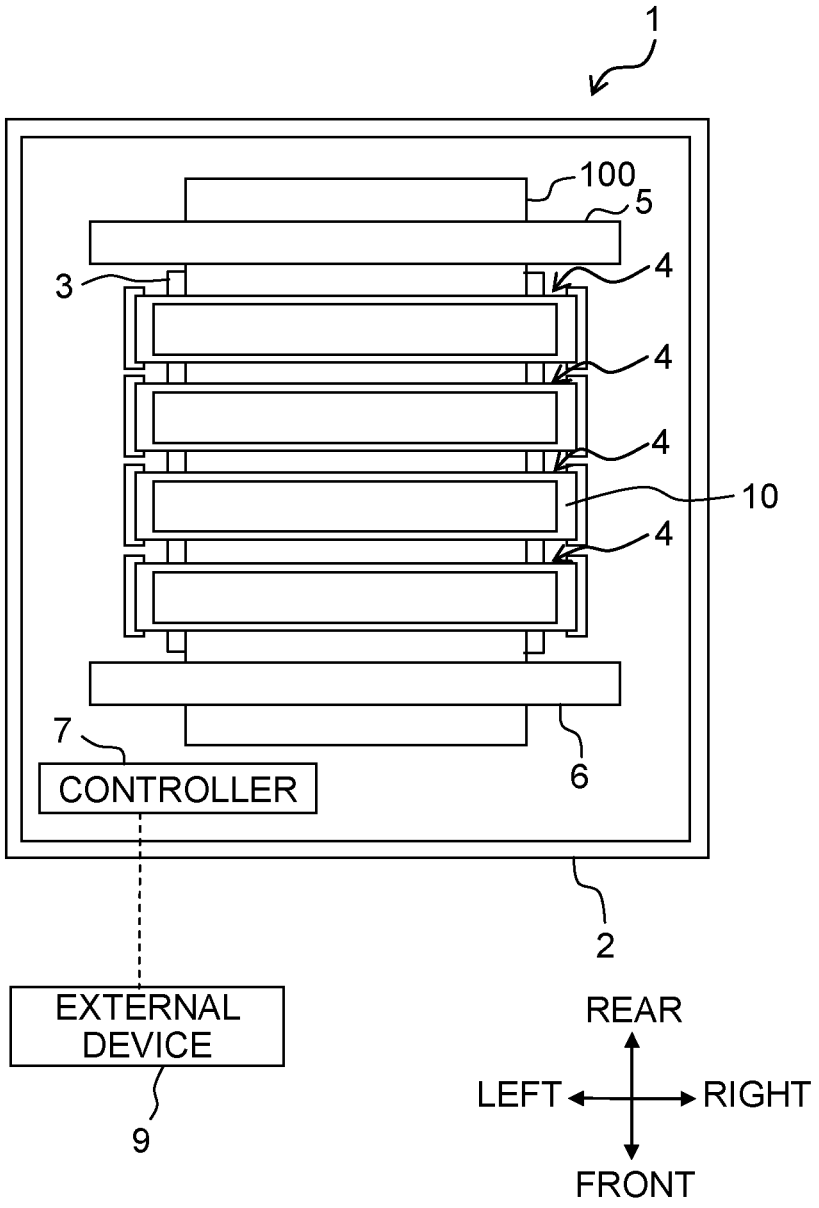
FIG. 1 is a plan view schematically depicting a printer according to a first embodiment of the present disclosure.

The present disclosure will be explained below based on the accompanying drawings depicting a printer according to a first embodiment. FIG. 1 is a plan view schematically depicting a printer 1. In FIG. 1, a conveyance direction of recording paper 100 (recording medium) corresponds to a front-rear direction of the printer 1. Further, a width direction of the recording paper 100 corresponds to a left-right direction of the printer 1. Further, an direction orthogonal to the front-rear direction and the left-right direction, that is, a direction perpendicular to the page of FIG. 1 corresponds to an up-down direction of the printer 1.

As depicted in FIG. 1, the printer 1 includes a platen 3 contained in a casing 2, four ink jet heads 4, two conveyance rollers 5 and 6, a controller 7, and the like.

The recording paper 100 is carried on the upper surface of the platen 3. The four ink jet heads 4 align in the conveyance direction above the platen 3. Each of the ink jet heads 4 is a so-called line-type head. The ink jet heads 4 are supplied with inks from an unshown ink tank. The four ink jet heads 4 are supplied with the inks in different colors.

As depicted in FIG. 1, the two conveyance rollers 5 and 6 are arranged respectively at the rear side and at the front side of the platen 3. The two conveyance rollers 5 and 6 are driven respectively by an unshown motor to convey the recording paper 100 on the platen 3 frontward.

The controller 7 includes an FPGA (Field Programmable Gate Array), an EEPROM (Electrically Erasable Programmable Read-Only Memory), a RAM (Random Access Memory), and the like. Further, the controller 7 may further include a CPU (Central Processing Unit) or ASIC (Application Specific Integrated Circuit), etc. The controller 7 is connected with an external device 9 such as a PC or the like in a data communicable manner and, based on print data sent from the external device 9, controls every unit of the printer 1.

Figure 2:
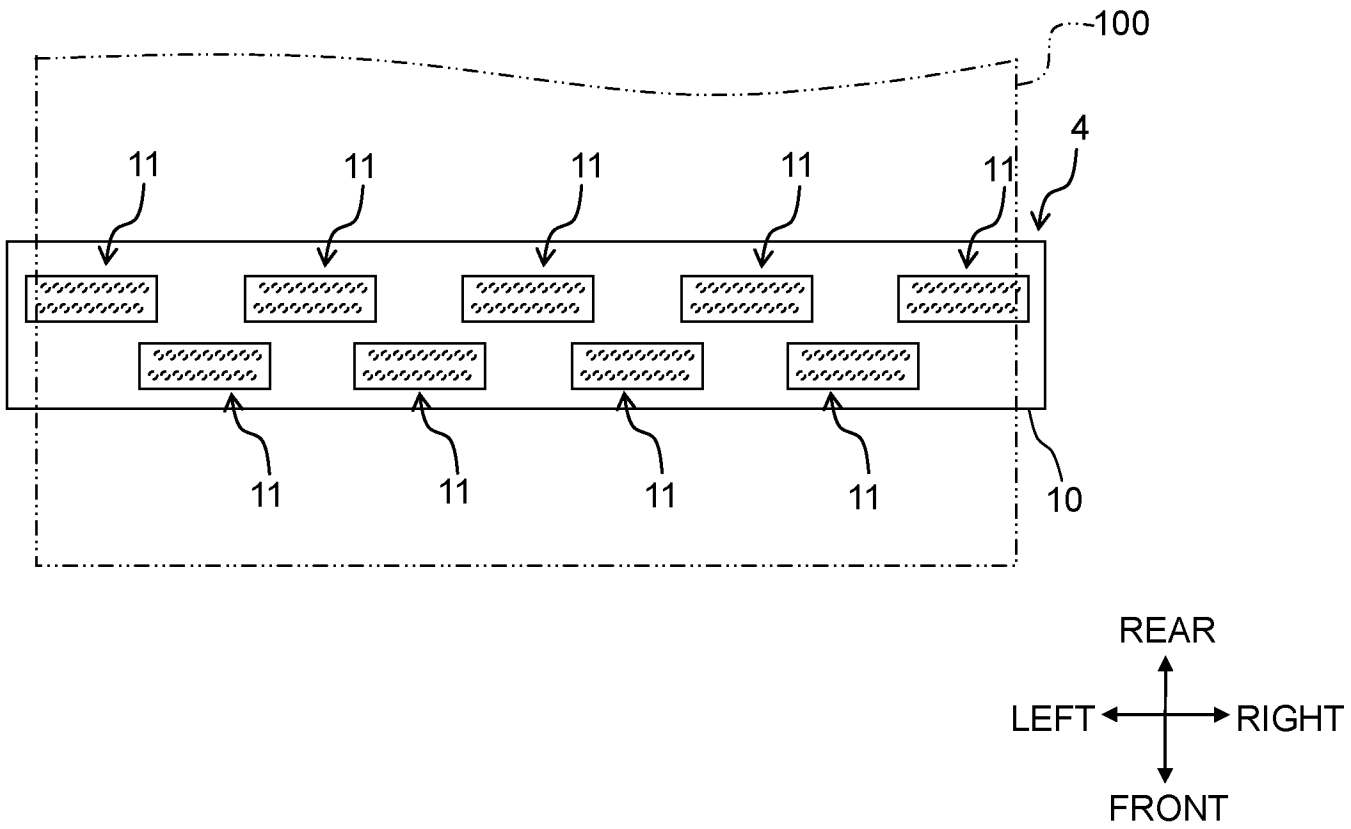
FIG. 2 is a plan view schematically depicting an ink jet head.

FIG. 2 is a plan view schematically depicting the ink jet head 4. As depicted in FIG. 2, the ink jet head 4 includes a plurality of liquid discharge apparatuses 11. The plurality of liquid discharge apparatuses 11 are fitted on a holder plate 10 in a staggered alignment. Each of the liquid discharge apparatuses 11 has a plurality of nozzles 30*d* aligning in the left-right direction. Further, because FIG. 2 is a schematic or simplified plan view, the number of nozzle rows is different from that of FIG. 9.

The controller 7 controls the motor for driving the conveyance rollers 5 and 6 to convey the recording paper 100 in the conveyance direction with the two conveyance rollers 5 and 6. Further, along with that, the controller 7 controls the four ink jet heads 4 to jet the inks from the nozzles 30*d* toward the recording paper 100. By virtue of this, image is printed on the recording paper 100.

Each of the liquid discharge apparatuses 11 includes a first frame 21 having a rectangular shape in planar view. The first frame 21 is provided with an opening 21*a* at the center. Four through holes 21*b* align in the front-rear direction to penetrate vertically in a left end portion of the first frame 21.

A heater 28 is provided inside the opening 21*a*. A plate spring 29 is provided above the heater 28. The plate spring 29 is formed with two positioning holes 29*a* aligning in the front-rear direction. The two positioning holes 29*a* are formed to correspond to two aftermentioned bosses 24*b*. A control substrate 31 is provided above the plate spring 29. The plate spring 29 biases the control substrate 31 upward. With the plate spring 29, a space is provided between the heater 28 and the control substrate 31 such that the plate spring 29 functions as the spacer. The heater 28 will be described in detail later on.

A second frame 32 having a rectangular shape in planar view is provided above the first frame 21. An opening 32*a* corresponding to the opening 21*a* of the first frame 21 is provided at the center of the second frame 32. A support collar 32*c* is provided on the inner circumferential surface of the opening 32*a* to project toward the center of the opening 32*a*. Four through holes 32*b* align in the front-rear direction to penetrate vertically, corresponding to the through holes 21*b* of the first frame 21.

The first frame 21 and the second frame 32 overlap with each other in the up-down direction. The opening 32*a* of the second frame 32 is arranged above the opening 21*a* of the first frame 21, while the through holes 32*b* of the second frame 32 are arranged above the through holes 21*b* of the first frame 21. A sealing member 33 is provided between the first frame 21 and the second frame 32 to seal the interspace between the first frame 21 and the second frame 32 in a liquid tight manner.

The heater 28 and the control substrate 31 are arranged inside the opening 21*a* of the first frame 21 and inside the opening 32*a* of the second frame 32. A holder collar 34 is provided on the support collar 32*c* of the second frame 32. The support collar 32*c* supports the holder collar 34. A cooling plate 35 is provided inside the holder collar 34. The holder collar 34 supports the cooling plate 35. An alignment frame 36 is provided above the cooling plate 35 and the second frame 32.

A plate-like channel member 30 is provided below the first frame 21. An actuator 20 is provided on the upper surface of the channel member 30. The actuator 20 is arranged inside the opening 21*a*.

Figure 6:
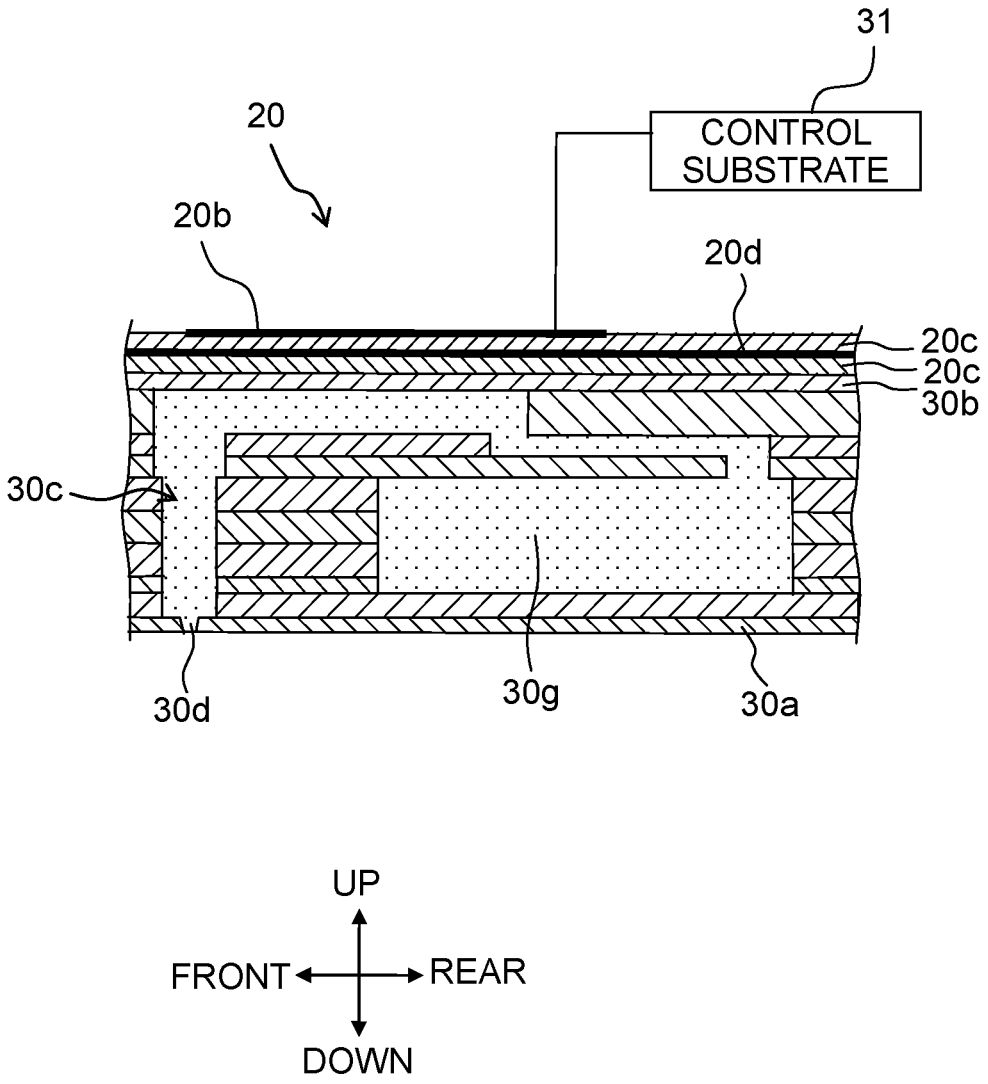
FIG. 6 is a partially enlarged cross-sectional view schematically depicting an actuator and a channel member.
Figure 7:
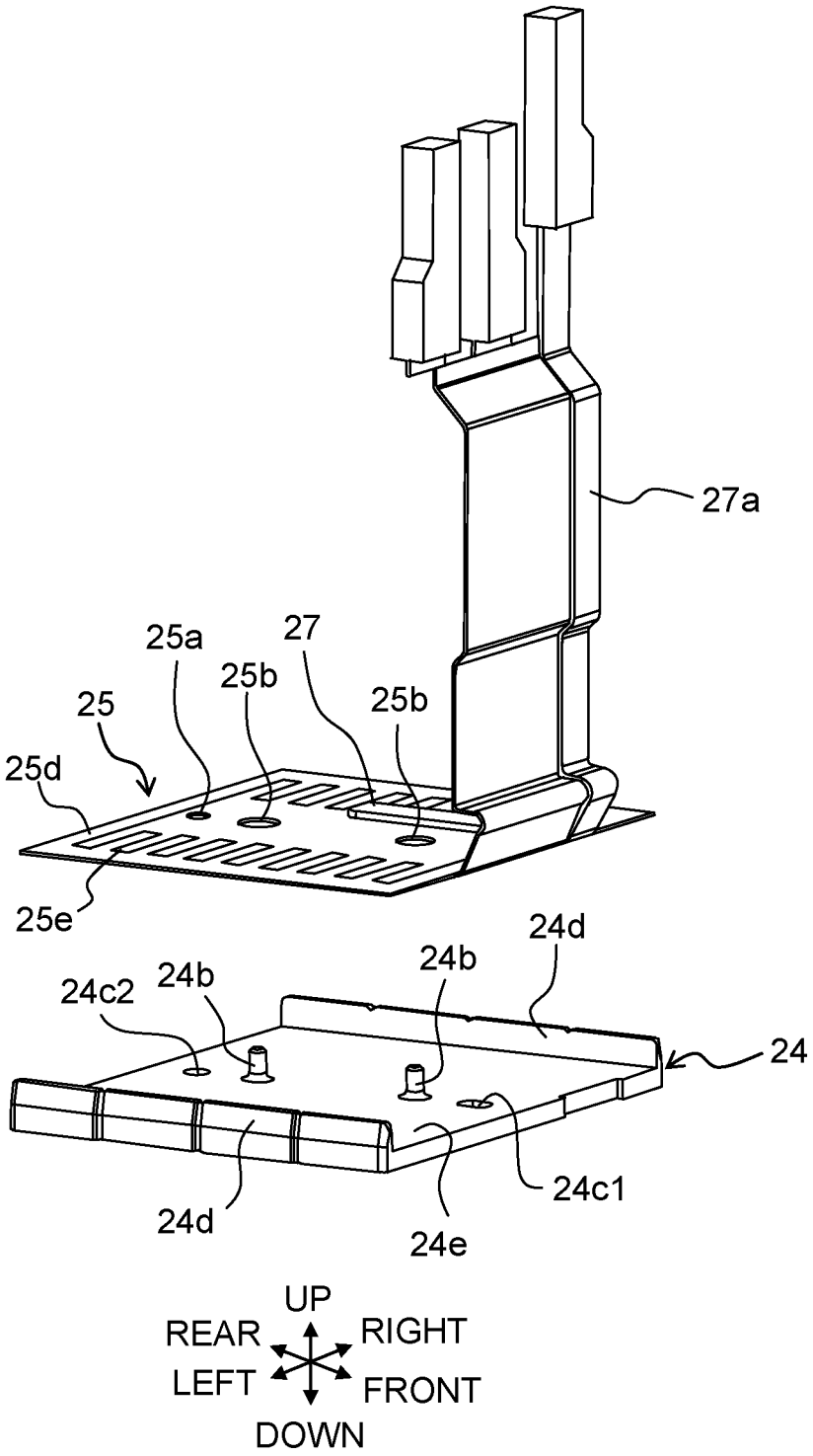
FIG. 7 is an exploded perspective view schematically depicting a heater.

The channel member 30 includes a plurality of plates in which through holes are formed to define flow channels respectively. The channel member 30 includes a nozzle plate 30*a* and a vibration plate 30*b*. In the nozzle plate 30*a*, the plurality of nozzles 30*d* align in the left-right direction (the direction perpendicular to the page of FIG. 6). A pressure chamber 30*c* is formed above each of the plurality of nozzles 30*d*. The pressure chambers 30*c* are linked to an aftermentioned common flow channel 30*g*.

The actuator 20 is arranged on the vibration plate 30*b*. The vibration plate 30*b* is provided above the pressure chambers 30*c* to block the top openings of the pressure chambers 30*c*. Two piezoelectric layers 20*c* are stacked in the actuator 20. A common electrode 20*d* is provided between the two piezoelectric layers 20*c*. The common electrode 20*d* is constantly kept at the ground potential. The actuator includes a plurality of individual electrodes 20*b* aligning in the left-right direction (the first direction). The plurality of individual electrodes 20*b* are provided on the upper piezoelectric layer 20*c* and arranged respectively above the plurality of pressure chambers 30*c*. The plurality of individual electrodes 20*b* are connected respectively with the control substrate 31.

Figure 3:
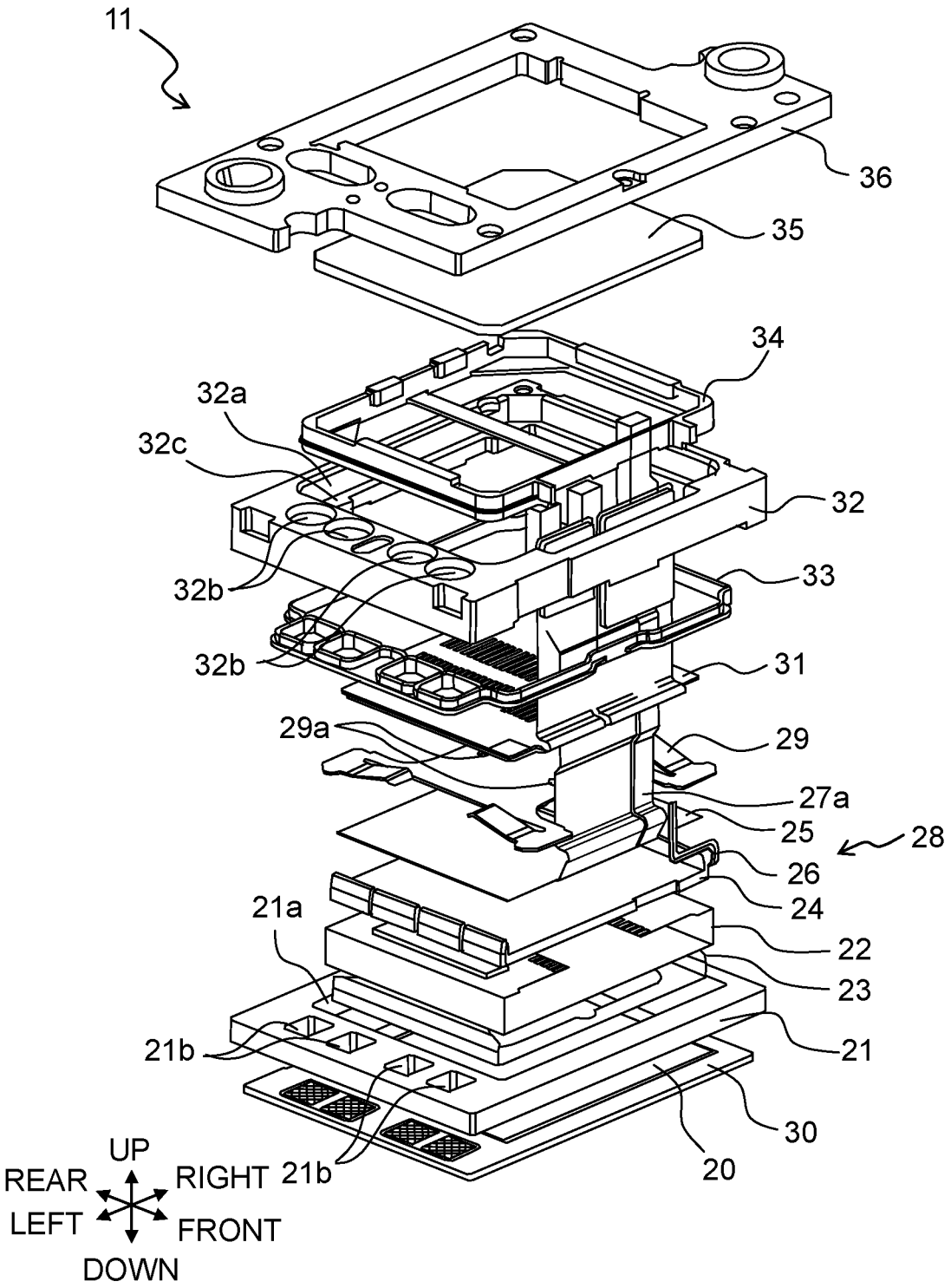
FIG. 3 is an exploded perspective view schematically depicting a liquid discharge apparatus.
Figure 4:
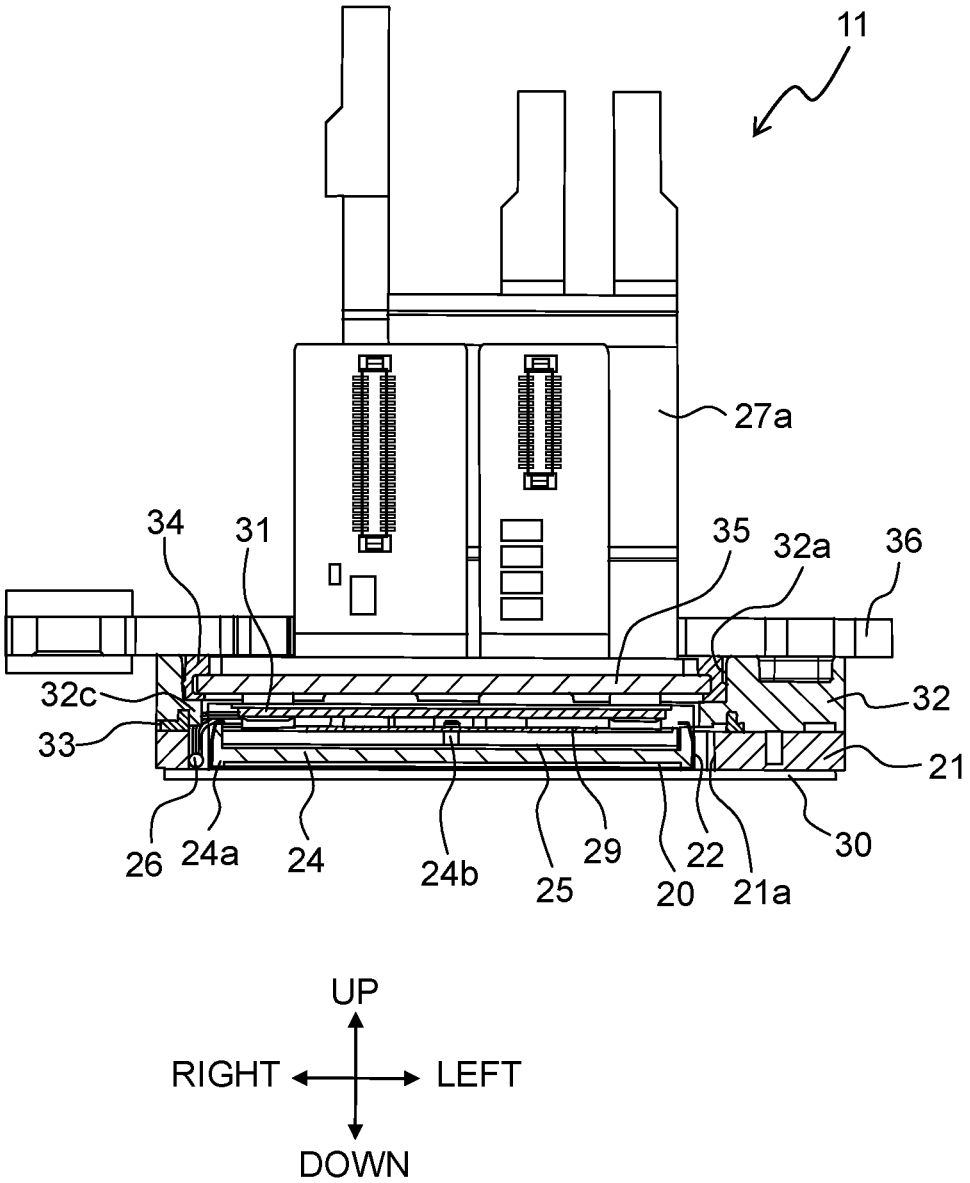
FIG. 4 is a vertical cross-sectional view schematically depicting the liquid discharge apparatus.

As depicted in FIGS. 3 and 4, a COF 22 is joined on the upper surface of the actuator 20 via a junction member 23 having a circular shape in planar view. The junction member 23 may be a double-stick tape, a sheet-like adhesive, or the like. A plurality of contact points are formed on the upper surface of the actuator 20 to correspond to the individual electrodes and to the common electrode.

Those plurality of contact points formed on the upper surface of the actuator 20 are joined respectively with a plurality of contact points provided on the COF 22 by using bumps. The heater 28 is provided on the upper surface of the COF 22. The COF 22 is wider than the heater 28 along the left-right direction, and a left end portion and a right end portion of the COF 22 are flexed upward to cover a left end portion and a right end portion of the upper surface of the heater 28.

The heater 28 includes a plate-like body 24, and a film heater 25. The liquid discharge apparatus 11 includes a first thermistor 26 and a second thermistor 27. The body 24 includes a plate portion 24*e*, and projecting portions 24*d* are formed respectively of a left edge portion and a right edge portion of plate portion 24*e* to project upward. Through holes 24*c*1 and 24*c*2 are formed to penetrate vertically in a front edge portion and a rear edge portion of the plate portion 24*e*, respectively.

The through hole 24*c*1 is a long hole extending in the front-rear direction while the through hole 24*c*2 is a circular hole. The through holes 24*c*1 and 24*c*2 are arranged in a central portion of the plate portion 24*e* according to the left-right direction. The two through holes 24*c*1 and 24*c*2 are used for positioning the body 24 to a jig in a process of attaching the junction member 23 to the body 24. The two bosses 24*b* align in the front-rear direction between the two through holes 24*c*1 and 24*c*2. The bosses 24*b* project upward from the plate portion 24*e*.

The film heater 25 includes a film portion 25*d*. The film portion 25*d* is formed of a resin such as polyimide or the like. The film portion 25*d* is formed with two through holes 25*b* penetrating vertically to correspond to the two bosses 24*b*. Further, the film portion 25*d* is provided with a flow-through hole 25*a* for the air to flow therethrough, corresponding to the through hole 24*c*2 formed in the rear edge portion of the plate portion 24*e*. Further, the film portion 25*d* is formed with a heating wire 25*e*. The second thermistor 27 is provided on the upper surface of the film portion 25*d*. The second thermistor 27 is capable of measuring the temperature of the film portion 25*d*. The second thermistor 27 is connected with the controller 7 via a wiring part 27*a*.

The film heater 25 is provided on the upper surface of the body 24. The two bosses 24*b* are inserted respectively into the two through holes 25*b* to project upward from the film portion 25*d* and be inserted into two positioning holes 29*a* of the plate spring 29. By inserting the bosses 24*b* into the positioning holes 29*a*, the position of the plate spring 29 is determined in the front-rear direction and in the left-right direction.

The flow-through hole 25*a* is arranged above the through hole 24*c*2 such that the through hole 24*c*2 is not blocked by the film portion 25*d*. Therefore, the air can flow through the flow-through hole 25*a* and the through hole 24*c*2. On the other hand, the through hole 24*c*1 is blocked by the film portion 25*d*. The heating wire 25*e* is not arranged in such a part of the film portion 25*d* as positioned above the through hole 24*c*1. Even if the heating wire 25*e* is arranged in the part of the film portion 25*d* positioned above the through hole 24*c*1, that is, the part of the film portion 25*d* blocking the opening of the through hole 24*c*1, it is still not possible for the heat produced in that part to transfer to the body 24. Because the heating wire 25*e* is not arranged in the part of the film portion 25*d* positioned above the through hole 24*c*1, it is possible to prevent the electric power from uneconomical consumption.

The first thermistor 26 is arranged on the upper surface of the channel member 30 to detect the temperature of the channel member 30. The first thermistor 26 is connected with the controller 7. Based on the temperature detected by the first thermistor 26 and the second thermistor 27, the controller 7 controls the supply current to the heating wire 25*e*.

Figure 5:
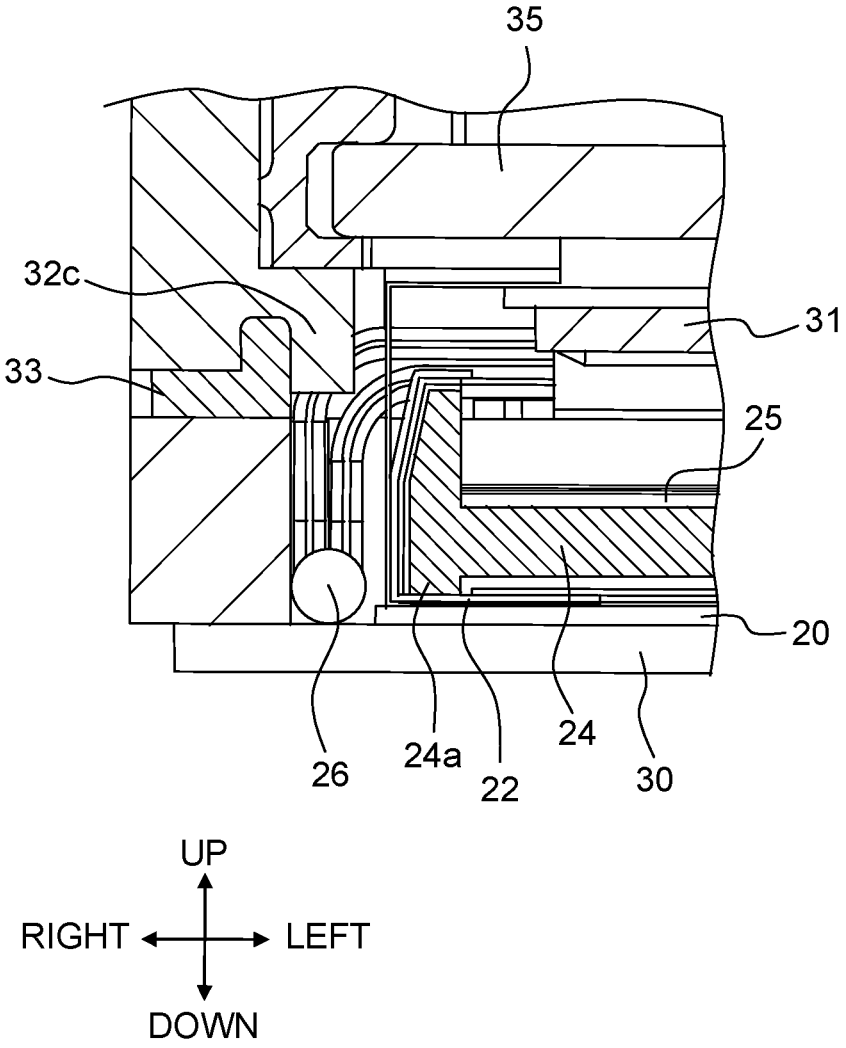
FIG. 5 is a partially enlarged vertical cross-sectional view schematically depicting the liquid discharge apparatus.
Figure 8:
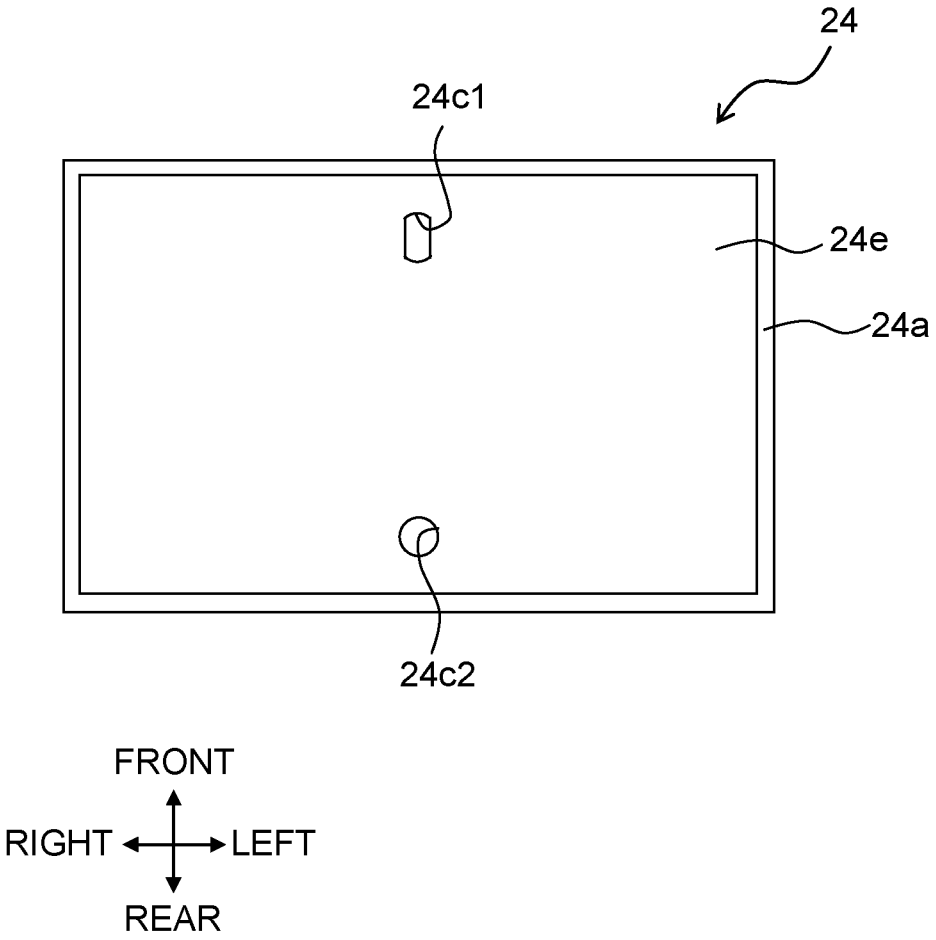
FIG. 8 is a bottom view schematically depicting a body.
Figure 9:
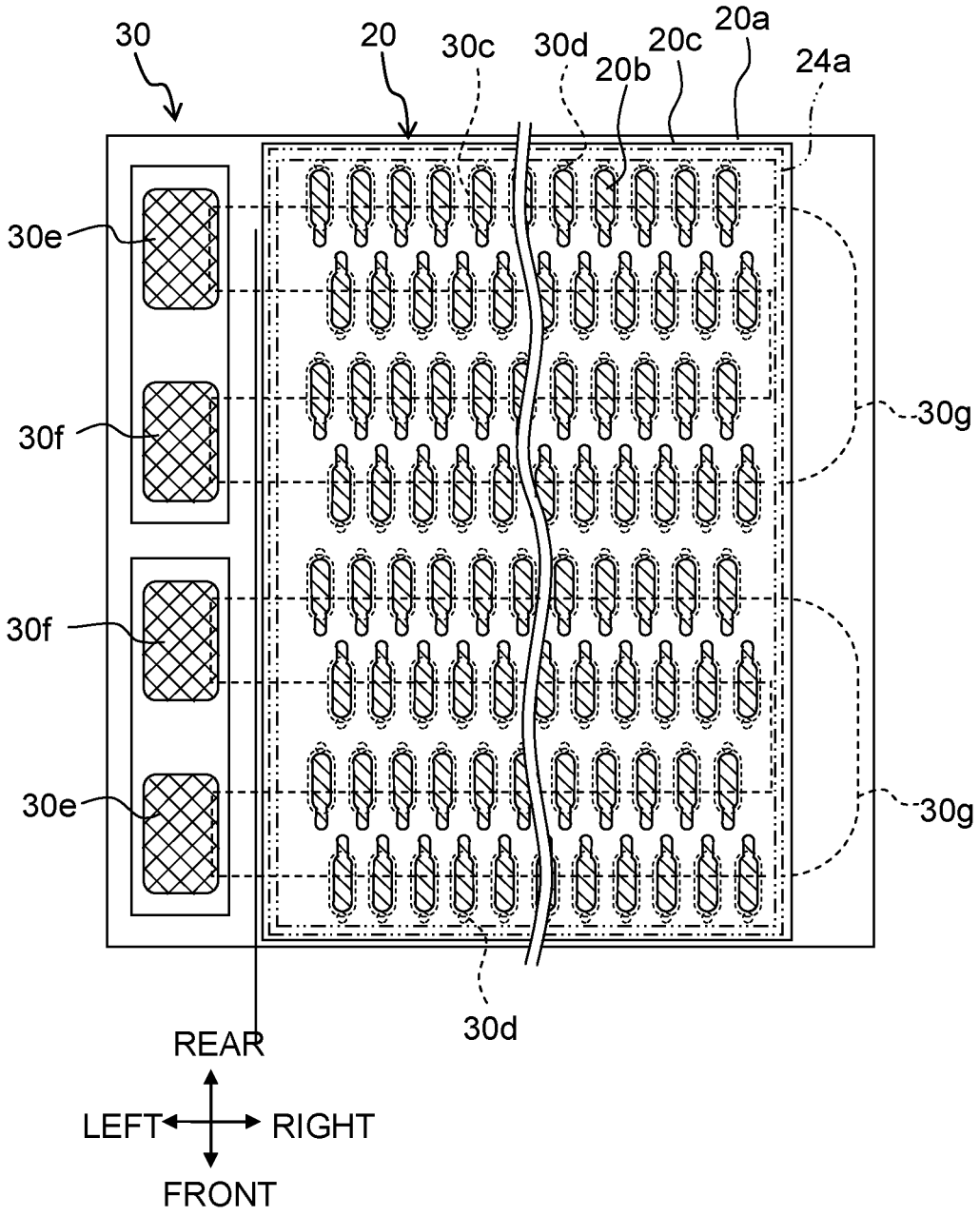
FIG. 9 is a schematic plan view schematically depicting a convex portion, the actuator, and the channel member.

As depicted in FIGS. 5 and 8, an annular convex portion 24*a* is provided to project downward in a circumferential portion of the bottom of the body 24. As depicted in FIG. 9, via the COF 22, the convex portion 24*a* is in contact with a circumferential part of the plurality of individual electrodes 20*b* on the upper surface of the actuator 20. Via the COF 22, the convex portion 24*a* is in contact with a circumferential part of the upper surface of the actuator 20. In other words, the convex portion 24*a* is arranged between the plurality of individual electrodes 20*b* and the outer edge of the channel member 30.

The aforementioned annular junction member 23 is arranged right below the convex portion 24*a*, and the convex portion 24*a* is attached to the COF 22 with the junction member 23. A reinforcement bump is formed in such a part of the COF 22 as pressed by the convex portion 24*a*, to fix the actuator 20 and the COF 22.

The channel member 30 includes two supply ports 30*e* supplied with the liquid. The two supply ports 30*e* align in the front-rear direction in a left edge portion of the channel member 30. In the left edge portion of the channel member 30, two discharge ports 30*f* align in the front-rear direction to discharge the liquid between the two supply ports 30*e*.

One of the supply ports 30*e* is linked to the one discharge port 30*f* adjacent to that supply port 30*e* through the common flow channel 30*g* having a U-shape in planar view. The common flow channel 30*g* is formed inside the channel member 30 to link to the respective pressure chambers 30*c*.

Further, the other supply port 30*e* is linked to the other discharge port 30*f* adjacent to that supply port 30*e* through another common flow channel 30*g* having a U-shape in planar view. The common flow channel 30*g* is also formed inside the channel member 30 to link to the respective pressure chambers 30*c*.

The ink supplied from the ink tank to the supply ports 30*e* passes through the common channels 30*g* to reach the pressure chambers 30*c*. The controller 7 applies a voltage between the common electrode 20*d* and the individual electrodes 20*b* to drive the piezoelectric layer 20*c* so as to vibrate the vibration plate 30*b*. Due to the vibration of the vibration plate 30*b*, a positive pressure is produced inside the pressure chambers 30*c* to jet the ink from the nozzles 30*d*, and a negative pressure is produced inside the pressure chambers 30*c* to supply the ink from the common channels 30*g* to the pressure chambers 30*c*.

The ink not supplied to the pressure chambers 30*c* passes through the common channels 30*g* and moves along a front edge portion or a rear edge portion of the channel member 30. Thereafter, it makes a U-turn in a right edge portion and moves through a central portion of the channel member 30 according to the front-rear direction to reach the discharge ports 30*f*. The ink discharged from the discharge ports 30*f* returns into the ink tank to be supplied again to the supply ports 30*e*.

The ink undergoes a decrease in temperature during the passage through the common channels 30*g*. Therefore, the controller 7 applies an electric current to the heating wire 25*e* to heat the body 24. The heat in the body 24 transfers to a circumferential portion of the channel member 30 via the convex portion 24*a*, and transfers from the circumferential portion to a central portion of the channel member 30, such that the whole of the channel member 30 is heated.

Being close to the external air, the periphery of the channel member 30 is easier to cool than the center. Because the convex portion 24*a* is in contact with the periphery of the actuator 20, the largest amount of heat is supplied to the periphery of the actuator 20 being easy to cool, such that the heat transfers therefrom to the periphery and center of the channel member 30. Therefore, it is possible to uniformize the temperature of the channel member 30; thus, it is possible to uniformize the ink temperature, thereby restraining the image quality from decreasing.

Further, the convex portion 24*a* is not in contact with the part of the actuator 20 where the plurality of individual electrodes are arrayed. Therefore, the body 24 does not bring about adverse effects such as impeding the actuator 20 from piezoelectric deformation, impeding the liquid from being jetted, and the like.

The film portion 25*d* blocks the through hole 24*c*1 of the body 24, but the heating wire 25*e* is not arranged on the film portion 25*d* positioned above the through hole 24*c*1. Therefore, it is possible to facilitate the heat release from the through hole 24*c*1 for the body 24, thereby preventing the body 24 from overheat.

The flow-through hole 25*a* of the film portion 25*d* is arranged over the through hole 24*c*2 of the body 24 such that the film portion 25*d* does not block the through hole 24*c*2. Therefore, it is possible to let the air flow through the flow-through hole 25*a* and the through hole 24*c*2. If the space enclosed by the body 24 and the COF 22 is tightly sealed, then the pressure inside the tightly sealed space increases due to the heat generation of the film heater 25, such that the liquid discharge apparatuses 11 are liable to damage because of detachment or the like between the plurality of relevant components. With the structure capable of letting the air flow therethrough via the flow-through hole 25*a* and the through hole 24*c*2, it is possible to prevent the liquid discharge apparatuses 11 from damage. Further, the film portion 25*d* may be formed with a flow-through hole corresponding to the through hole 24*c*1, to further improve the air permeability.

By providing the plate spring 29 between the heater 28 and the control substrate 31, a space is formed between the heater 28 and the control substrate 31. Therefore, it is possible to prevent the control substrate 31 from overheat. Further, with the plate spring 29 blocking the radiation from the heater 28, it is possible to prevent the control substrate 31 from being overheated by the radiation heat from the heater 28.

The junction member 23 is arranged right below the convex portion 24*a* such that the convex portion 24*a* presses the COF 22 on the second frame 32. With the part of the COF 22 pressed by the convex portion 24*a* as the fulcrum, it is possible to easily bend up the left end portion and the right end portion of the COF 22.

<Modifications>

In the first embodiment as described above, the convex portion 24*a* is in contact with the circumferential part of the plurality of individual electrodes 20*b* on the upper surface of the actuator 20, via the COF 22. However, present teaching is not limited to such structures. For example, the convex portion 24*a* may be directly in contact with the circumferential part of the plurality of individual electrodes 20*b* on the upper surface of the actuator 20. Alternatively, the convex portion 24*a* may be in contact with the circumferential part of the plurality of individual electrodes 20*b* on the upper surface of the actuator 20, via the heat-transfer member having a high heat transfer rate, such as thermal grease. In other words, the convex portion 24*a* may be indirectly in contact with the upper surface of the actuator 20 via the heat-transfer member.

Figure 10:
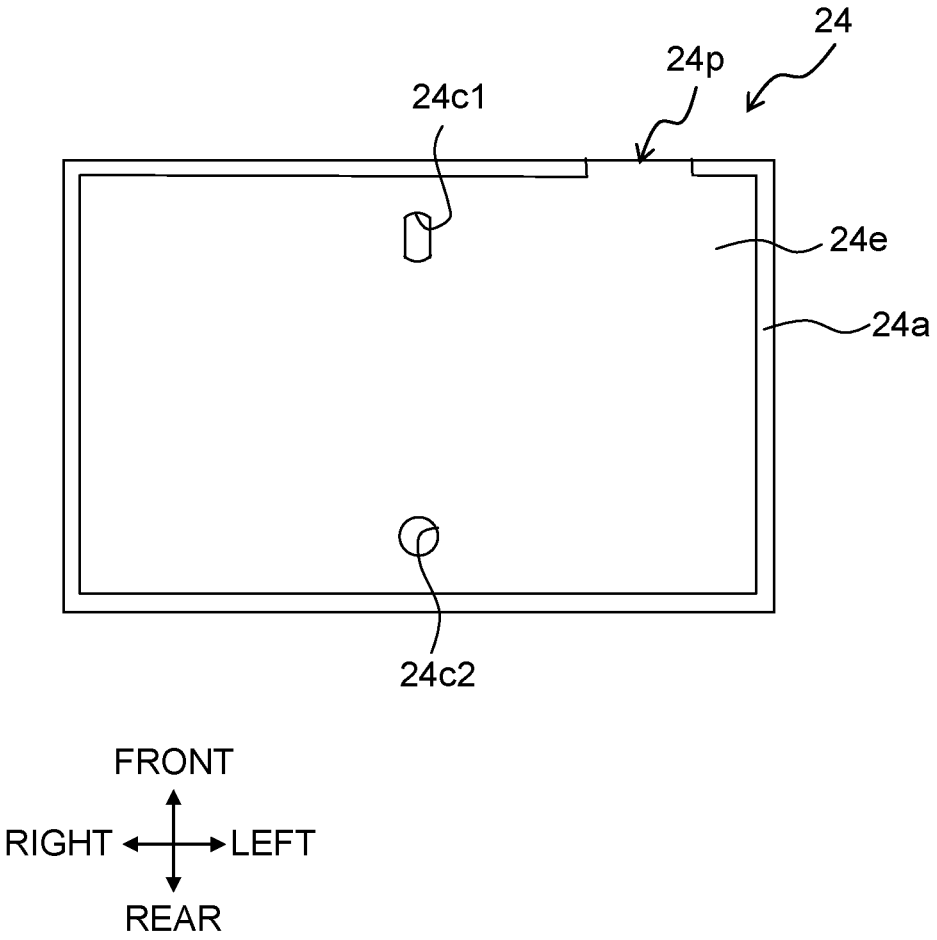
FIG. 10 is a bottom view schematically depicting a body according to a first modification having changed part of the configuration of the first embodiment.
Figure 11:
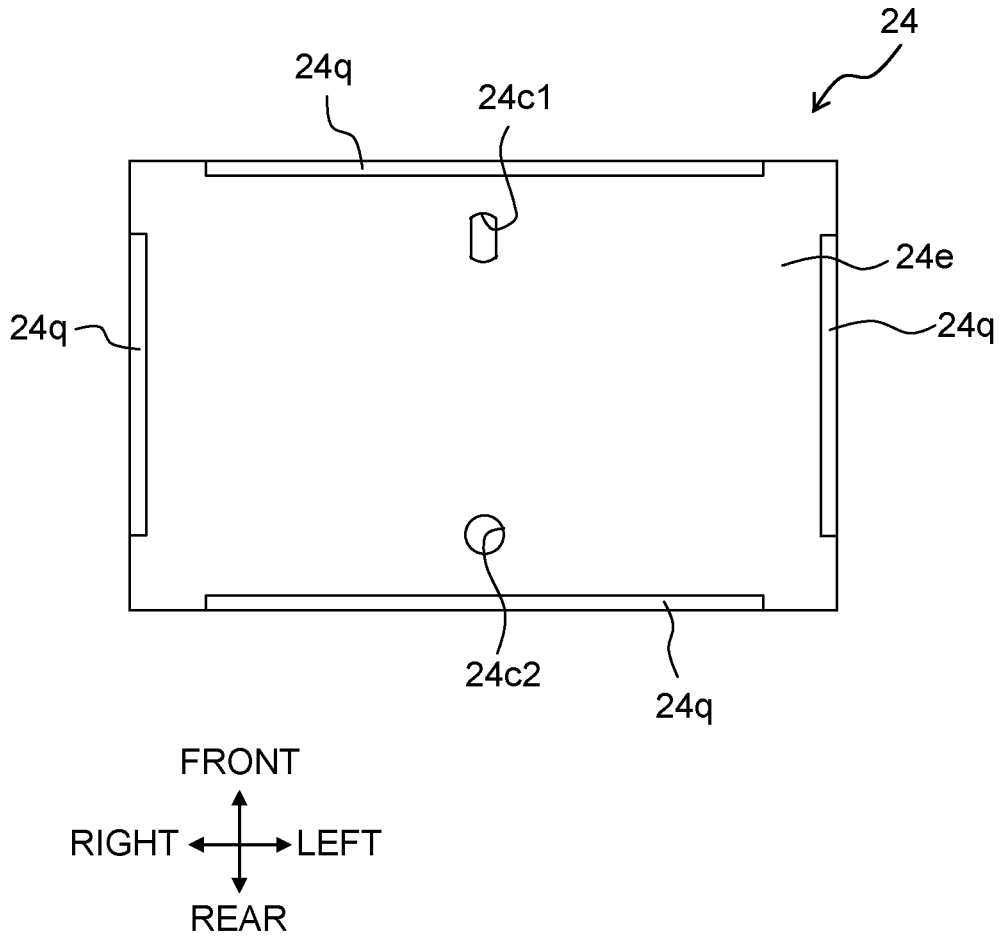
FIG. 11 is a bottom view schematically depicting a body according to a second modification having changed part of the configuration of the first embodiment.

As depicted in FIG. 10, a notch or an opening 24*p* may be provided in part of the convex portion 24*a*. With the notch or opening 24*p*, it is possible to improve the air permeability. Further, the convex portion 24*a* is not limited to a single member. As depicted in FIG. 11, for example, a plurality of convex portions 24*q* may be provided. In this case, too, the plurality of convex portions 24*q* may be arranged at the outer edge side of the channel member 30 than the plurality of individual electrodes 20*b* such that, for example, the plurality of convex portions 24*q* may be arranged intermittently around the plurality of individual electrodes 20*b* or arranged at least in one of a front edge portion, a rear edge portion, a right edge portion, and a left edge portion of the upper surface of the channel member 30.

Figure 12:
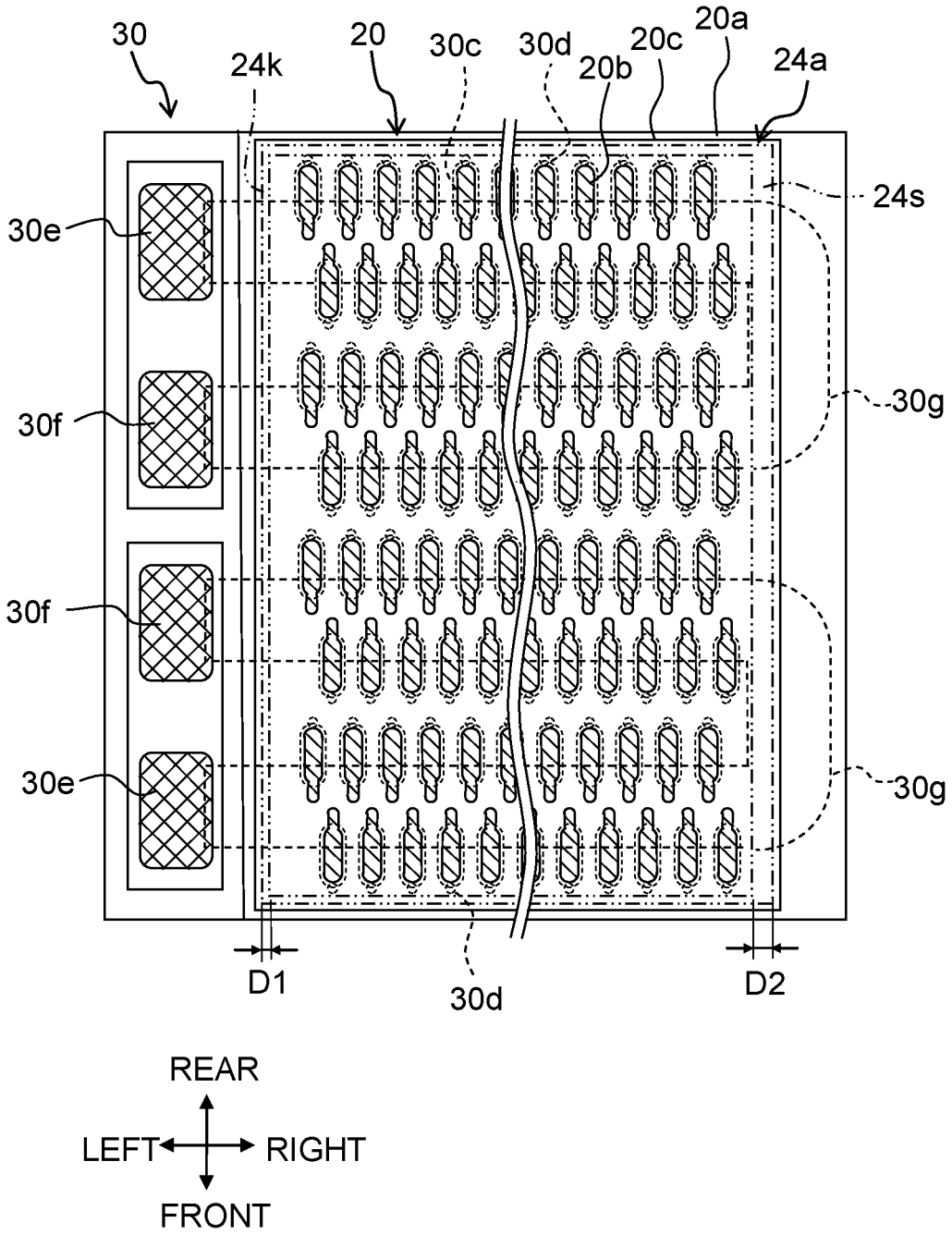
FIG. 12 is a schematic plan view schematically depicting a convex portion, an actuator, and a channel member according to a third modification having changed part of the configuration of the first embodiment.

Further, as depicted in FIG. 12, the convex portion 24*a* may include a left-side part 24*k* (to be referred to below as a first part) and a right-side part 24*s* (to be referred to below as a second part) which are different in the width from left to right. In particular, the first part 24*k* is arranged between the supply ports 30*e* and the discharge ports 30*f*, and a second convex portion 124*b*, and the second part 24*s* has a left-right width D2 which is larger than a left-right width D1 of the first part 24*k*.

The ink in parts away from the supply ports 30*e* is cooled to a lower temperature during flowing through the common channels 30*g*, and thus decreases more easily in temperature than the ink in the vicinity of the supply ports 30*e*. In the modification depicted in FIG. 12, the width D2 of the second part 24*s* away from the supply ports 30*e* is larger than the width D1 of the first part 24*k*, such that the second part 24*s* has a larger area in contact with the channel member 30 than the first part 24*k*. Hence, more amount of heat transfers to parts of the channel member 30 away from the supply ports 30*e* such that it is possible to uniformize the ink temperature, thereby restraining the image quality from decreasing.

Second Embodiment

The present disclosure will be explained below based on the accompanied drawings depicting a printer according to a second embodiment.

Figure 13:
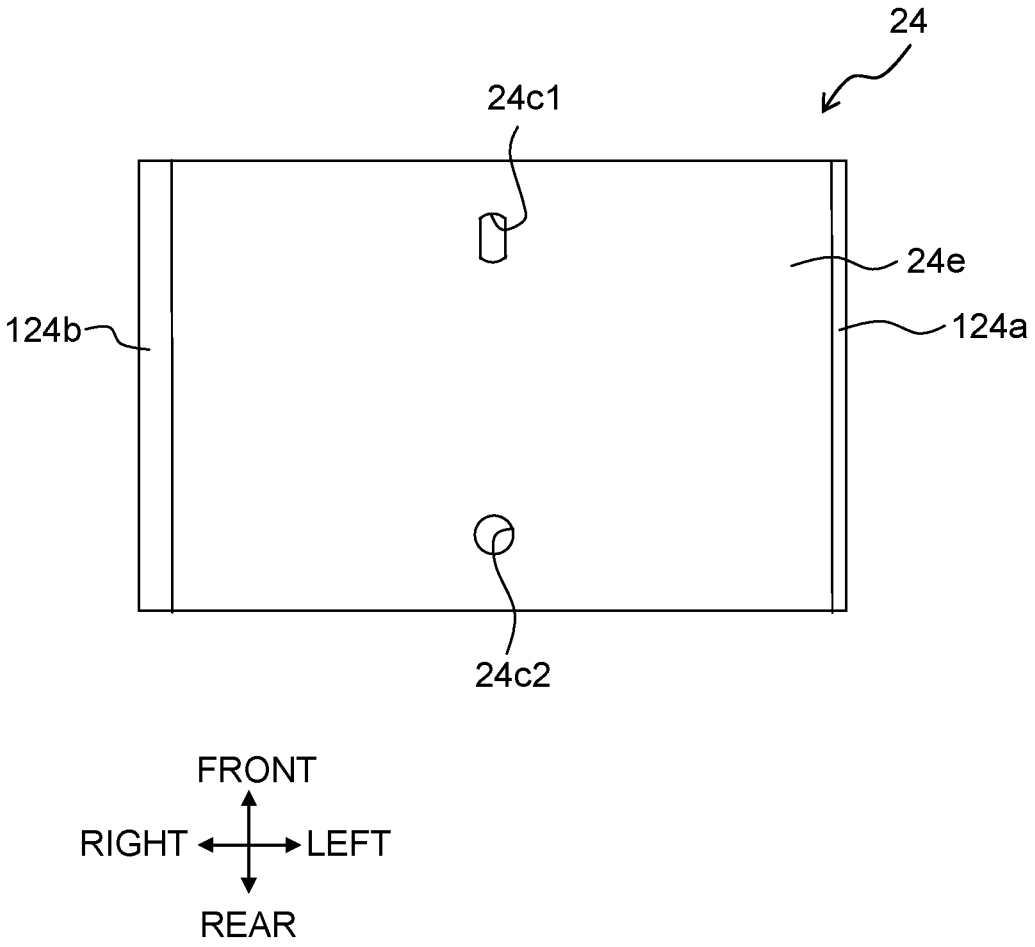
FIG. 13 is a bottom view schematically depicting a body according to a second embodiment of the present disclosure.
Figure 14:
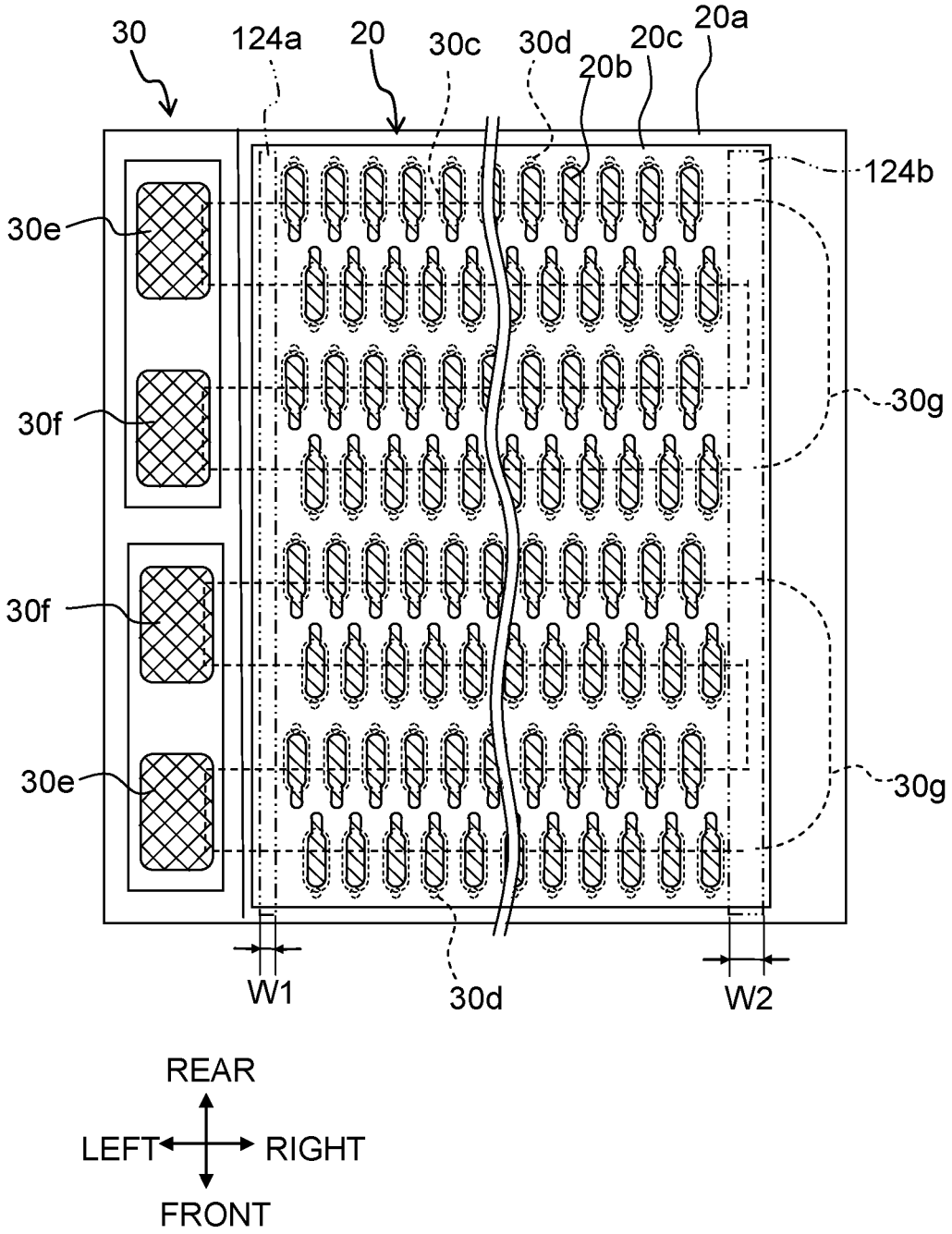
FIG. 14 is a schematic plan view schematically depicting a first convex portion, a second convex portion, an actuator, and a channel member according to the second embodiment.

As depicted in FIG. 13, a first convex portion 124*a* is provided in a left edge portion of the bottom of the body 24 to extend in the front-rear direction (the second direction) and project downward. Further, a second convex portion 124*b* is provided in a right edge portion of the bottom of the body 24 to extend in the front-rear direction and project downward. The first convex portion 124*a* and the second convex portion 124*b* stand away from each other in the left-right direction (the first direction). As depicted in FIG. 14, in the left-right direction, the first convex portion 124*a* is arranged between the supply ports 30*e* and discharge ports 30*f*, and the second convex portion 124*b*. The first convex portion 124*a* is arranged in the vicinity of the supply ports 30*e*, while the second convex portion 124*b* stands away from the supply ports 30*e*. The second convex portion 124*b* has a width W2 which is larger than a width W1 of the first convex portion 124*a*, along the left-right direction.

The ink in parts away from the supply ports 30*e* is cooled to a lower temperature during flowing through the common channels 30*g*, and thus decreases more easily in temperature than the ink in the vicinity of the supply ports 30*e*. In the second embodiment, the width W2 of the second convex portion 124*b* away from the supply ports 30*e* is larger than the width W1 of the first convex portion 124*a*, such that the second convex portion 124*b* has a larger area in contact with the channel member 30 than the first convex portion 124*a*. Hence, more amount of heat transfers to parts of the channel member 30 away from the supply ports 30*e* such that it is possible to uniformize the ink temperature, thereby restraining the image quality from decreasing.

It should be understood that the embodiments disclosed above are exemplary but not limitary in each and every aspect. It is possible to combine the technical characteristics described in the respective embodiments with one another. The scope of the present invention is intended to include all scopes equivalent to those of the appended claims, and all changes without departing from the true spirit and scope of the present invention.

What is claimed is:

1. A liquid discharge apparatus comprising:

an actuator including a plurality of individual electrodes aligning in a first direction;

a channel member joined to a first surface of the actuator and including a plurality of pressure chambers aligning in the first direction;

a heater proximate a second surface of the actuator opposite the first surface and including a body; and a convex portion extending from the body towards the actuator, the convex portion being located in a circumferential area of the body at least partially around a periphery of the body, wherein the convex portion is in thermal contact with a circumferential part of the second surface of the actuator, wherein the convex portion is arranged between the plurality of individual electrodes and an outer edge of the actuator in the circumferential part of the second surface of the actuator.

2. The liquid discharge apparatus according to claim 1, wherein the convex portion is located at the periphery of the plurality of individual electrodes.

3. The liquid discharge apparatus according to claim 1, wherein the heater includes a body arranged above the actuator, and a film heater fitted on the body; and wherein the convex portion projects from the body toward the actuator.

4. The liquid discharge apparatus according to claim 3, wherein a through hole is provided in the body, and wherein the film heater is arranged in a position without overlap with the through hole.

5. The liquid discharge apparatus according to claim 3, wherein a through hole is provided in the body, and wherein the film heater is provided with a second through hole in communication with the through hole.

6. The liquid discharge apparatus according to claim 3, wherein a through hole is provided in the body, wherein the film heater has a part blocking the through hole, and wherein a heating wire of the film heater is not arranged in the part blocking the through hole.

7. The liquid discharge apparatus according to claim 3, wherein a first through hole and a second through hole are provided in the body, wherein the film heater is provided with a third through hole in communication with the first through hole, and wherein the film heater includes a part blocking the second through hole.

8. The liquid discharge apparatus according to claim 7, wherein a heating wire of the film heater is not arranged in the part blocking the second through hole.

9. The liquid discharge apparatus according to claim 1, wherein the channel member includes a common channel configured to supply a liquid to the plurality of pressure chambers, and a supply port configured to supply the liquid to the common flow channel; wherein the convex portion includes a first part and a second part which stand away from each other in the first direction, the first part being arranged between the supply port and the second part in the first direction.

10. The liquid discharge apparatus according to claim 9, wherein the first part extends in a second direction parallel to the actuator and orthogonal to the first direction, the second part extends in the second direction, and wherein a width of the second part in the first direction is larger than a width of the first part in the first direction.

11. The liquid discharge apparatus according to claim 1, furthering comprising: a control substrate arranged above the heater to control the drive of the actuator; and a spacer arranged between the heater and the control substrate.

12. The liquid discharge apparatus according to claim 1, wherein a flexible substrate is located between the heater and the actuator, and a junction member is located below the convex portion to join the flexible substrate and the actuator.

13. The liquid discharge apparatus according to claim 1, wherein the actuator includes a first end in the first direction, wherein the plurality of individual electrodes includes a first individual electrode located nearest to the first end of the actuator in the first direction, and wherein the convex portion is arranged between the first end of the actuator and the first individual electrode in the first direction.

14. The liquid discharge apparatus according to claim 1, wherein the actuator includes a second end in a second direction parallel to the actuator and orthogonal to the first direction, wherein each of the plurality of individual electrodes includes an end in the second direction that is nearest to the second end of the actuator in the second direction, and wherein the convex portion is arranged between the second end of the actuator and the end of each of the plurality individual electrodes in the second direction.

* * * * *